US006789672B2

(12) United States Patent
Takahashi et al.

(10) Patent No.: US 6,789,672 B2
(45) Date of Patent: Sep. 14, 2004

(54) PACKAGING APPARATUS FOR ROLL PRODUCT AND PACKAGE OF ROLL PRODUCT

(75) Inventors: Nobumitsu Takahashi, Minami-Ashigara (JP); Makoto Ikeda, Minami-Ashigara (JP); Kunihiro Sumida, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/200,455

(22) Filed: Jul. 23, 2002

(65) Prior Publication Data

US 2003/0019185 A1 Jan. 30, 2003

(30) Foreign Application Priority Data

Jul. 27, 2001 (JP) ..... 2001-227367
Jul. 27, 2001 (JP) ..... 2001-227368

(51) Int. Cl.[7] ..... B65D 85/67
(52) U.S. Cl. ..... 206/410; 206/401; 206/455; 53/409
(58) Field of Search ..... 206/389, 397, 206/401, 410, 413, 415, 416, 455; 242/170; 53/409

(56) References Cited

U.S. PATENT DOCUMENTS

| | | | | |
|---|---|---|---|---|
| 2,105,368 | A | * | 1/1938 | Parsons |
| 4,184,307 | A | | 1/1980 | Kataoka |
| 4,793,485 | A | * | 12/1988 | Bertolotti |
| 5,353,933 | A | * | 10/1994 | Takahashi et al. |
| 2001/0040112 | A1 | * | 11/2001 | Picnta |

FOREIGN PATENT DOCUMENTS

| | | |
|---|---|---|
| EP | 0 414 265 A2 | 2/1991 |
| JP | 52-30589 | 3/1977 |
| JP | 55-3212 | 1/1980 |
| JP | 58-125422 | 7/1983 |
| JP | 58-134825 A | 8/1983 |
| JP | 60-129306 | 8/1985 |
| JP | 62-58966 | 12/1987 |
| JP | 2-1202 | 1/1990 |
| JP | 3-98813 | 4/1991 |
| JP | 5-112337 | 5/1993 |
| JP | 6-88572 | 11/1994 |

* cited by examiner

*Primary Examiner*—David T. Fidei
(74) *Attorney, Agent, or Firm*—Sughrue Mion, PLLC

(57) ABSTRACT

When packaging a roll product in which a belt-shaped sensitized material has been wound around a core with a light shielding sheet, the packaging apparatus is capable of forming an angle pleated portion of a gather-folded portion which covers a roll end surface with stability, and the package of roll product is capable of retaining the light shielding property and the moisture resistance while making the area of the sheet as small as possible. The gather-folding apparatus forms angle pleated portions on end surface wrapping material by means of both plate-shaped folding members which come into plane contact from outside of the end surface wrapping material and inter support arms which come into line-contact with the inner peripheral surface of the end surface wrapping material. This gather-folding apparatus forms, by means of both the surfaces of the plate-shaped folding members and the line of the inter support arm, two planes of folded planes sandwiching the line concerned. In this case, since these two planes of folded planes are formed with equal tension, the angle pleated portion can be formed with stability.

1 Claim, 20 Drawing Sheets

PACKAGING APPARATUS FOR ROLL PRODUCT AND PACKAGE OF ROLL PRODUCT

BACKGROUND OF THE INVENTION

1. Field of the Invention

The present invention relates to a packaging apparatus for rolled products and a package for a rolled product, and more particularly to a packaging apparatus for packaging, with a light shielding sheet, a belt-shaped sensitized material rolled product such as photographic printing paper and photographic film or the like which have been wound in a roll shape, and a package.

2. Description of the Related Art

Japanese Patent Application Publication No. 5-112337 discloses a package of a rolled product capable of opening a sealed package by drawing out a leading end of a light shielding sheet with which the circumferential surface of a belt-shaped sensitized material rolled product has been packaged.

In this package, as shown in FIGS. 19 and 20, a roll product 1 of photosensitive material or the like is wound around a cylindrical core 2 having the substantially same width as the roll product 1; and to a leading end 1A of the roll product 1, one end 3A of circumferential surface wrapping material 3 having the same width as or slightly larger width than the roll product 1 is joined such that edge portions 1B of the roll product 1 substantially coincide with edge portions 3B of the circumferential surface wrapping material 3. On the inner sides of both side edges of the circumferential surface wrapping material 3, end surface wrapping materials 4 are superimposed and heat bonded. Thus, border lines C of the heat bonded portion between the circumferential surface wrapping material 3 and the end surface wrapping materials 4 substantially coincide with the side edges 1B of the roll product 1, and serve as reinforcement portions when opening.

The circumferential surface wrapping material 3 is wound around the roll product 1, and its leading end 1C is bonded to the roll product 1 with a terminal tape 5. Also, cylindrical portions of the end surface wrapping material 4 protruding from the end surfaces of the roll product 1 are gather-folded along the end surfaces of the roll product 1 by a gather-folding apparatus (not shown), and inner side portions 6 of the gather-folded portions are fit into the core 2 with bushings 7 by pressing the bushings 7 into the core 2. Thus, the light shielding property and the moisture resistance of the roll product 1 are retained.

As the gather-folding apparatus, there have conventionally been proposed various apparatuses, and of those, apparatuses which have been disclosed in Japanese Patent Publication No. 55-3212 and Japanese Utility Model Publication No. 2-1202 have a plurality of folding members which move from the outside of the cylindrical portions toward the roll central axis. These folding members are moved in the above-described direction to fold the cylindrical portions inside, whereby pleats of the wrapping material are formed between the folding members, and these pleats are folded onto the roll end surfaces to thereby gather-fold the cylindrical portions.

Since, however, the above-described conventional gather-folding apparatuses are constructed to forms the pleats only through the use of the folding member, there is the problem that the fold angle becomes non-uniform resulting from the stiffness, habit and the like of the wrapping material so that ridges of crest folded portions of the pleats do not have any equal length. Although a package of sensitized material is caused to retain the light shielding property and the moisture resistance by fitting the inner side portions of the gather-folded portions into the core with the bushings, and when the length of the ridges of the crest folded portions is non-uniform as described above, there may be pleats which cannot be fitted, that is, there may exist pleats of which the length of the ridges is short, and therefore, there is the drawback that the light shielding property and the moisture resistance are impaired.

Hence, as a gather-folding apparatus which prevents such a drawback, there is a gather-folding apparatus disclosed in Japanese Patent Publication No. 62-58966. This gather-folding apparatus comprises: a plurality of pressing plates which move toward the roll central axis on the outside of the cylindrical portions of a light shielding sheet protruding outwardly from the end surfaces of the roll; a plurality of pleat formation rods which support the cylindrical portions from the inside toward the outside; and a moving mechanism which synchronizes these pleat formation rods to the movement of the pressing plates to move in the direction of the roll central axis. According to this gather-folding apparatus, when folding out the cylindrical portions inwardly by the movement of the pressing plates, the cylindrical portions are supported from inside by the plurality of pleat formation rods. Thus, there can be formed angle pleated portions comprising trough folded portions folded inwardly by the pressing plates and crest folded portions stretched outwardly by the pleat formation rods.

Also, a gather-folding apparatus disclosed in Japanese Patent Publication No. 6-88572 comprises: a plurality of moving pieces which move toward the roll central axis on the outer side of the cylindrical portions of the light shielding sheet protruding outwardly from the roll end surfaces; a plurality of support spokes which support the cylindrical portion from the inner side toward the outside; and an opening/closing mechanism for opening/closing the support spokes like an umbrella. According to this gather-folding apparatus, when folding out the cylindrical portion inside by the movement of the moving pieces, the cylindrical portions are supported from inside by means of the support spokes which have been opened like an umbrella. Thus, there can be formed angle pleated portions comprising trough folded portions folded inwardly by the moving pieces and crest folded portions stretched outwardly by the support spokes.

Since, however, the gather-folding apparatuses disclosed in Japanese Patent Publication Nos. 62-58966 and 6-88572 are constructed such that the inner surface of the cylindrical portions are supported by the pleat formation rods or the support spokes in point-contact, in the case of soft wrapping material, there is a drawback that the angle pleated portions cannot be formed with stability because the wrapping material is broken or is turned up.

Since the light shielding sheet for wrapping a sensitized material roll product is a wrapping material having the light shielding property and the moisture resistance, it is expensive. Therefore, the roll product is preferably packaged at a minimum surface area.

However, in order to provide the roll product with the light shielding property and the moisture resistance, the portions to be fitted into the core with the bushings are required for the light shielding sheet as described above. For this reason, in the conventional package, emphasis has been placed on the light shielding property and the moisture resistance, and concerning the provision of the light shielding property and the moisture resistance by making the area of the light shielding sheet as small as possible, no contrivance has been performed.

Also, in the conventional package of a roll product, since the trough portions of the gather-folded angle pleated portion are directed toward the roll center and the ridges of the crest portions are not directed toward the roll center, the length of the light shielding sheet has been uselessly long.

SUMMARY OF THE INVENTION

The present invention has been achieved in views of the above-described state of affairs, and is aimed to provide a packaging apparatus for a roll product having a gather-folding apparatus capable of forming an angle pleated portion with stability, and a package of a roll product capable of making the area of the sheet as small as possible to provide the light shielding property and the moisture resistance.

In order to attain the above-described object, the present invention is directed to a packaging apparatus for a roll product which covers an outer peripheral surface of a roll made of a belt-shaped material wound around a core in a roll shape with a sheet having larger width than a width of the roll to gather-fold a cylindrical portion of the sheet protruding outwardly from an end surface of the roll by a gather-folding apparatus along the roll end surface, wherein the gather-folding apparatus comprises: a plurality of plate-shaped folding members which are arranged along a circumferential surface of the roll and are movably arranged between a retracted position retracted from the cylindrical portion of the sheet and a folded position where the cylindrical portion is folded in a plane-contact state toward the roll end surface; a plurality of bar-shaped inter support members which are arranged along the circumferential surface of the roll at positions corresponding to openings between the plurality of plate-shaped folding members, and which are movably arranged between a retracted position retracted from the cylindrical portion of the sheet and a supporting position where the cylindrical portion is supported in a line-contact state from inside; and a rotation device by which the roll or the plurality of plate-shaped folding members are rotated with a central axis of the roll being centered, and after the plurality of inter support members are positioned from the retracted position to the supporting position, the plurality of plate-shaped folding members are positioned from the retracted position to the fold position, whereby a plurality of angle pleated portions to which tension has been given by inter support members and the plate-shaped folding members are formed at the cylindrical portion of the sheet, thereafter, the plurality of inter support members are positioned at the retracted position, and the roll or the plurality of plate-shaped folding members are rotated by the rotation device to fold the angle pleated portions on the roll end surface to thereby form a gather-folded portion.

Also, in order to attain the above-described object, the present invention is directed to a package of a role product, which covers an outer peripheral surface of a roll made of a belt-shaped material wound around a cylindrical core in a roll shape with a sheet having larger width than the width of the roll to gather-fold a cylindrical portion of the sheet protruding outwardly from an end surface of the roll by a gather-folding apparatus along the roll end surface, and which a bushing member is pressed into the core to thereby fit an inner peripheral edge of a gather-folded portion by the core and the bushing member, wherein ridges of crest folded portions of a plurality of angle pleated portions which form the gather-folded portion are formed to be longer than ridges of trough folded portions; when gather-folding is performed, each of the angle pleated portions lies on top of the angle pleated portion adjacent thereto; and the ridges of the crest folded portions face a center of the roll product.

According to the gather-folding apparatus, by means of both the plate-shaped folding member which comes into plane-contact with the sheet cylindrical portion from outside, and the bar-shaped inter support member which comes into line-contact with the inner peripheral surface of the cylindrical portion, the angle pleated portion is formed. In other words, the gather-folding apparatus according to the present invention is to form, by means of both the surface of the plate-shaped folding member and the line of the inter support member, two planes of folded planes sandwiching the line concerned. In this case, since these two planes of folded planes are formed with equal tension, the angle pleated portion comprising these two planes of folded planes can be formed with stability. A plurality of angle pleated portions are formed along the circumferential surface of the roll, and these angle pleated portions can be folded along the role end surface to thereby form the gather-folded portion.

A method of forming the gather-folded portion by the gather-folding apparatus is (1) a step of positioning a plurality of inter support members from the retracted position to the supporting position, and (2) a step of positioning a plurality of plate-shaped folding members from the retracted position to the fold position. By these two steps, a plurality of angle pleated portions to which tension has been given by the inter support members and the plate-shaped folding members can be formed at the cylindrical portion. Next, (3) a step of positioning a plurality of inter support members in the retracted position. (4) a step of bringing the wrapping material into tight contact with the roll end surface by a plurality of plate-shaped folding members to complete the projections and depressions. (5) a step of rotating the roll or the plurality of plate-shaped folding members by the rotation device to thereby fold the angle pleated portion on the roll end surface. By the above-described steps, the gather-folded portion can be formed. Accordingly, the gather-folding apparatus according to the present invention is capable of forming the gather-folded portion by five steps: (1) to (5), and therefore, the tact of the packaging apparatus is improved.

Also, the gather-folding apparatus is characterized in that the plate-shaped folding member has been formed into a rectangular triangle shape. When an angle pleated portion formed by this plate-shaped folding member is folded, ridges of crest folded portions of all the angle pleated portions face toward the roll center. More specifically, since the fold angles of all the angle pleated portions become uniform by forming the plate-shaped folding member into a rectangular triangle shape, the light shielding property and the moisture resistance is enhanced. In contrast to this, in the case where the plate-shaped folding member is formed into an isosceles triangle shape, the crest folded portion of the angle pleated portion is separated from the roll center, and therefore, a long wrapping material is required to retain the light shielding property and the moisture resistance, and the cost is increased.

Further, the gather-folding apparatus is characterized in that the inter support member is formed in an L-character shape and that the proximal end of the inter support member is rotatably supported in such a manner that the supporting portion of the inter support member can move in an oblique direction with respect to the roll end surface. Thus, only by rotating the inter support member from the supporting position to the retracted position, the inter support member can be retracted from the insertion area of the bushing member into the core. Irrespective of the operation of the inter support member, the bushing member can approach to the roll, and therefore, the insertion tact of the bushing member is improved.

In contrast to this, in the gather-folding apparatus disclosed in, for example, Japanese Patent Publication No. 6-88572, since the opening/closing mechanism of the support spoke is arranged coaxially with the roll central axis, when inserting the bushing member into the core, the opening/closing mechanism obstructs the operation. Therefore, since time for causing the opening/closing mechanism to escape from the same axle is required, the insert tact of the bushing member cannot be improved.

The inter support member is characterized in that it is located midway between the rectangular triangle shaped plate-shaped folding members and rotates with some angle in order to open the core portion of the roll.

In the package of a roll product according to the present invention, since ridges of crest folded portions of a plurality of angle pleated portions which form the gather-folded portion are formed to be longer than the ridges of the trough folded portions; gathers are folded in such a manner that the angle pleated portion lies on top of the angle pleated portion adjacent thereto; and the ridges of the crest folded portions has been directed toward the center of the roll product, the area of the sheet is made as small as possible and the light shielding property and the moisture resistance can be provided.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Hereinafter, with reference to the accompanying drawings, the detailed description will be made of a packaging apparatus for roll products and a package for roll products according to preferred embodiments of the present invention.

Figure 1:
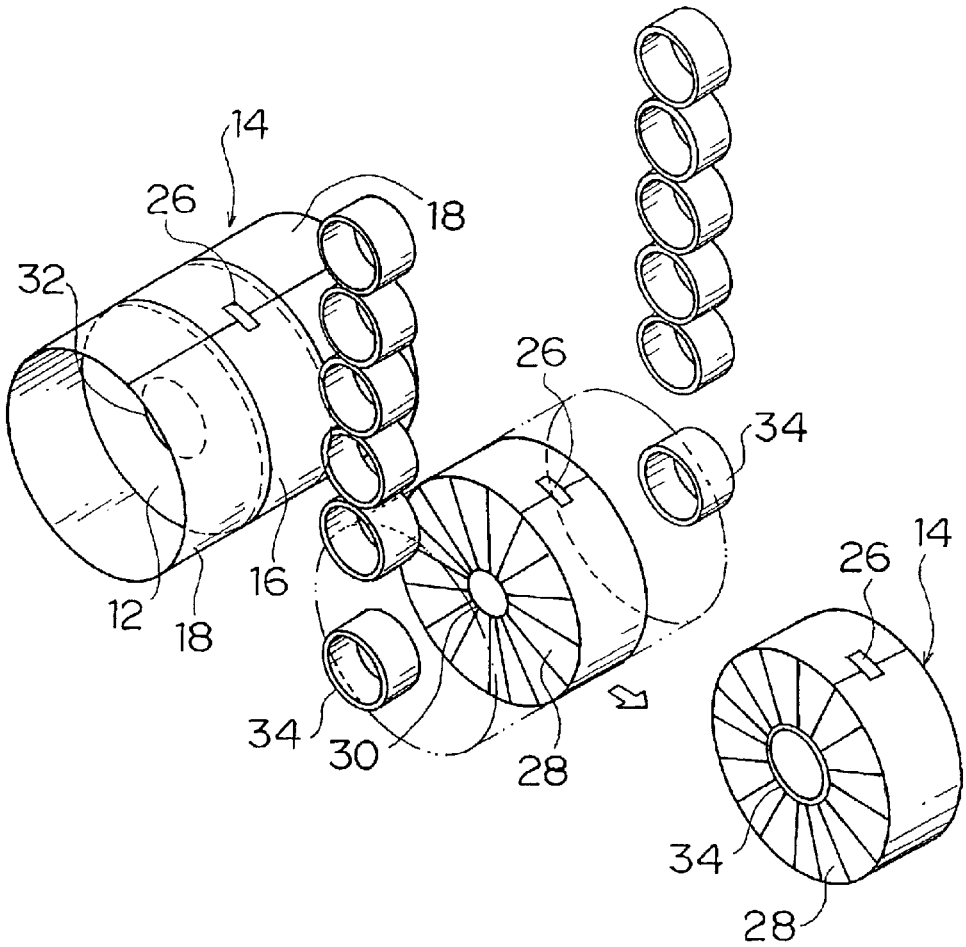
FIG. 1 is an explanatory view schematically showing a packaging process by a packaging apparatus for a roll product.

FIG. 1 is a schematic diagram showing a packaging procedure for a belt-shaped sensitized material rolled product, to which a packaging apparatus for roll products according to an embodiment of the present invention has been applied. A light shielding sheet 14 for packaging a roll product 12 is composed of a circumferential surface wrapping material 16 to be wound on the circumferential surface of the roll product 12 and end surface wrapping materials 18, 18 to be gather-folded on both end surfaces of the roll product 12.

In this light shielding sheet 14, the circumferential surface wrapping material 16 thereof is wound around the circumferential surface of the roll product 12, and the leading end portion of the circumferential surface wrapping material 16 is bonded to the roll product 12 with a terminal tape 26.

Also, cylindrical portions of the end surface wrapping materials 18, 18 protruding from the end surfaces of the roll product 12 are gather-folded on the end surfaces of the roll product 12 by a gather-folding apparatus to be described later. Inner peripheral portions 30, 30 of gather-folded portions 28, 28 (only the gather-folded portion 28 on one side is shown in FIG. 1) are fitted into a cylindrical core 32 of the roll product 12 with a pair of bushings 34 by pressing the bushings 34 into the cylindrical core 32 from both ends. Thus, the light shielding property and the moisture resistance of the roll product 12 are retained. For example, a three-layer structure object obtained by sandwiching PET film between black polyfilms is used for the circumferential surface wrapping material 16 and the end surface wrapping materials 18.

Figure 2:
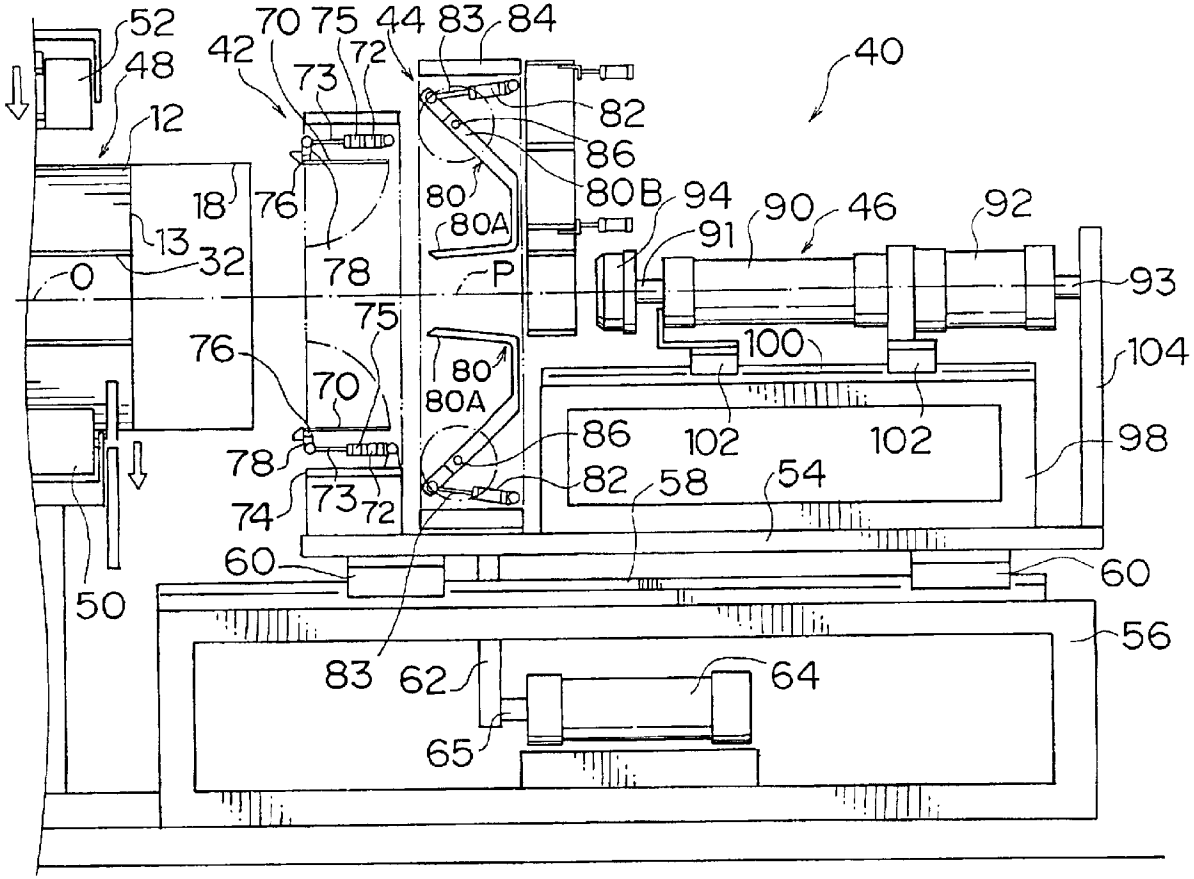
FIG. 2 is a side view indicating a position of a gather-folding apparatus when a roll product is set on a gather-folding stage.
Figure 3:
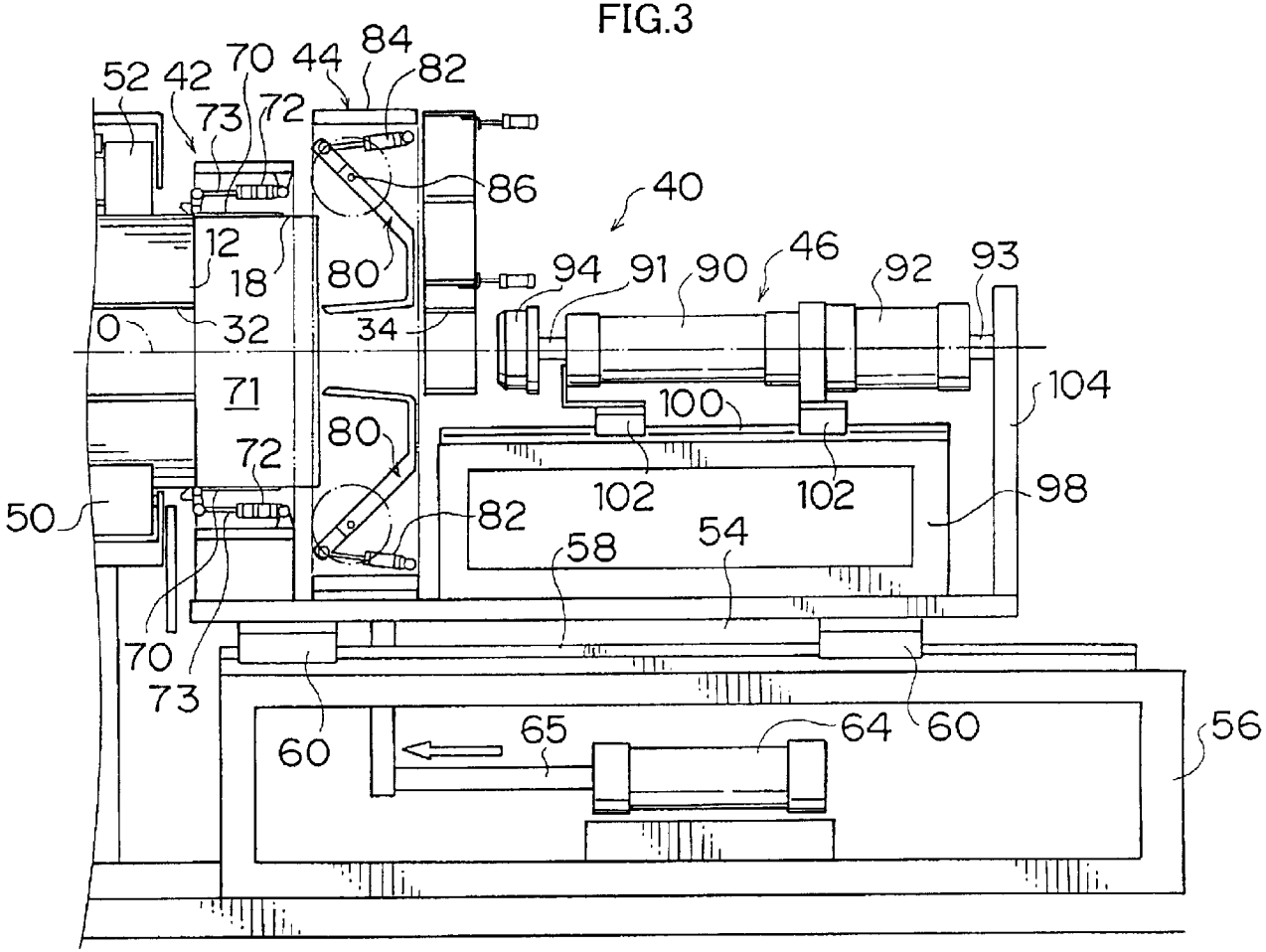
FIG. 3 is a side view indicating a position of the gather-folding apparatus immediately after a roll product is set on the gather-folding stage.

Next, with reference to FIGS. 2 and 3, the description will be made of the gather-folding apparatus. In this respect, the gather-folding apparatus 40 shown in FIGS. 2 and 3 is an apparatus for gather-folding the end surface wrapping material 18 on one side, and a gather-folding apparatus for gather-folding the end surface wrapping material 18 on the other side is not shown. The gather-folding apparatus on the other side is quite the same as the gather-folding apparatus 40 on the one side in structure, and since these apparatuses operate in synchronism, the description will be made of the gather-folding apparatus 40 on the one side here, and the description of the gather-folding apparatus on the other side will be omitted.

Figure 12:
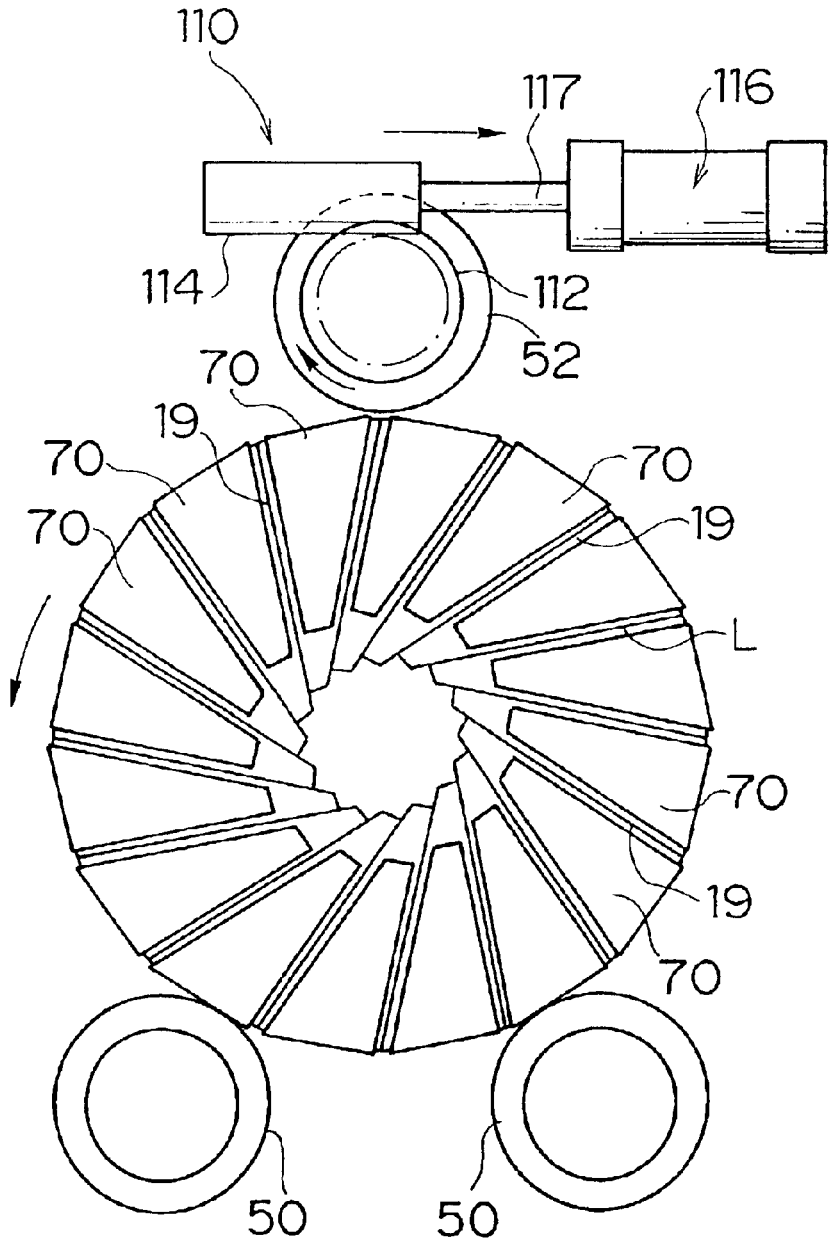
FIG. 12 is a front view showing the plate-shaped folding member when the plate-shaped folding member has been positioned at the pleated portion formation position.

The gather-folding apparatus 40 is set up to oppose the end surface 13 of the roll product 12, and a fold unit 42, an inter-support unit 44 and a bushing press-in unit 46 are arranged in order from the end surface 13 to constitute the gather-folding apparatus 40. In this respect, the roll product 12 is placed on a pair of receiving rollers 50, 50 (see FIG. 12) set up on a gather-folding stage 48, and a driving roller (corresponding to a rotation device) 52 abuts on the top surface of the roll product 12 as shown in FIGS. 3 and 12. The roll product 12 rotates around a roll central axis O by a rotating force transmitted from the driving roller 52.

The fold unit 42, the inter-support unit 44 and the bushing press-in unit 46 are set up on a common table 54. This table 54 is movably supported by a guide rail 58 laid on a base 56 through linear sliders 60, 60. The guide rail 58 is disposed in a direction orthogonal to the end surface 13 of the roll product 12 set in the gather-folding stage 48. Further, to the lower portion of the table 54, a piston 65 of an air cylinder device 64 is coupled through a coupling member 62. Accordingly, an expansion and contraction operation of the piston 65 causes the table 54 to advance toward or retract from the end surface 13 of the roll product 12.

Figure 4:
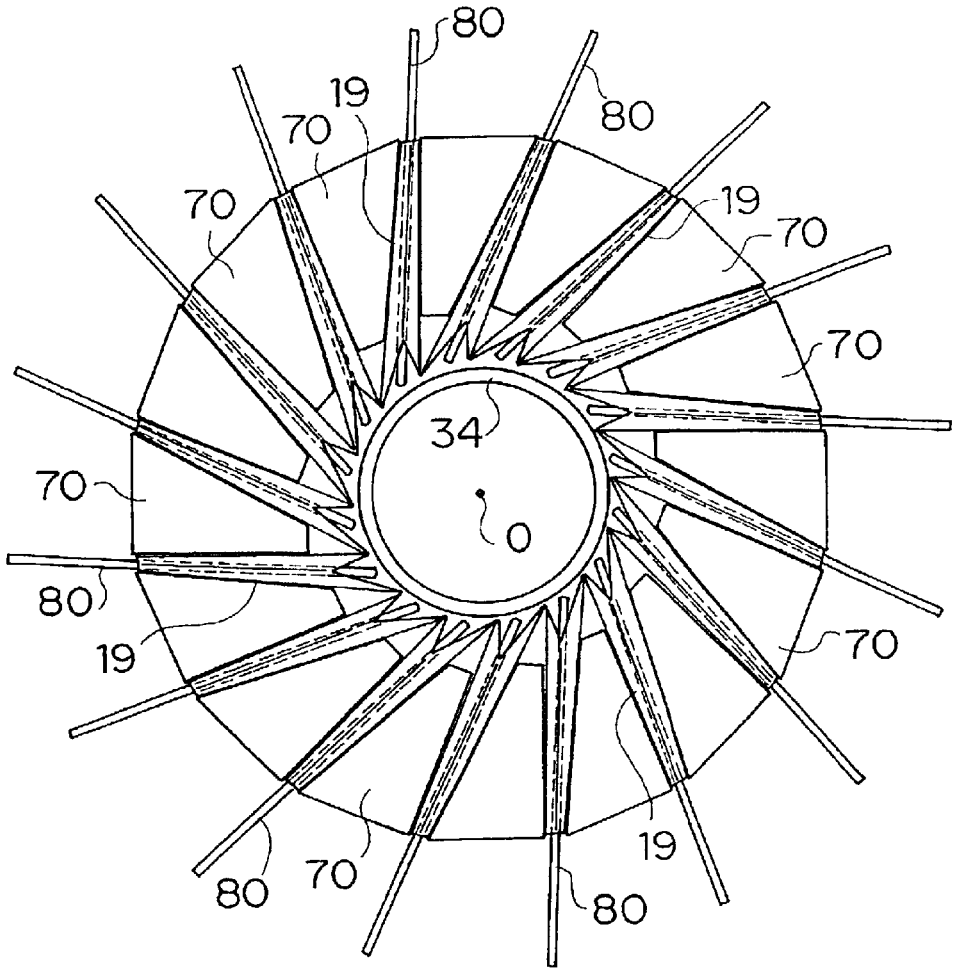
FIG. 4 is an explanatory view showing layout and structure of a plate-shaped folding member of the gather-folding apparatus.

The fold unit 42 is, as shown in FIG. 4, composed of: a plurality of plate-shaped folding members 70, 70 . . . ; and air cylinder devices 72, 72 . . . and air cylinder devices 75, 75 . . . shown in FIG. 2 which operate the plate-shaped folding members 70, 70 . . . in two stages.

The plate-shaped folding members 70 are arranged along the circumferential surface of the roll product 12 within a ring-shaped unit body 74 formed to have a larger diameter than the outer diameter of the roll product 12. Also, the plate-shaped folding members 70 are pivotally supported by the unit body 74 through pins 76, and are swingably supported by the pistons 73 of the air cylinder devices 72 through links 78. Thus, the plate-shaped folding members 70 are located at retracted positions represented with solid lines in FIGS. 2, 3 and 5 when the pistons 73 extend, and the plate-shaped folding members 70 are located at pleated portion formation positions (corresponding to the fold positions) represented with solid lines in FIGS. 6 and 7 when the pistons 73 contract, and are located at gather-folded portion formation positions represented with solid lines in FIGS. 8 and 9 by a continuing contracting operation.

Also, the plate-shaped folding members 70 are, as shown in FIG. 4, formed in a substantially rectangular triangle shape, and are arranged on a circle in such a manner that oblique lines of two adjacent plate-shaped folding members 70 do not face to each other.

The inter support unit 44 shown in FIG. 2 is, as shown in FIG. 4, composed of: a plurality of inter support arms (corresponding to a bar-shaped inter support member) 80, 80 . . . ; and air cylinder devices 82, 82 . . . of FIG. 2 for operating the inter support arms 80, 80 . . . respectively.

The inter support arms 80 are arranged along the circumferential surface of the roll product 12 within a ring-shaped unit body 84 formed to have a larger diameter than the unit body 74 of the fold unit 42. Also, the inter support arms 80 are pivotally (swingably) supported by the unit body 84 through pins 86, and are swingably supported by the pistons 83 of the air cylinder devices 82. Therefore, the inter support arms 80 are located at retracted positions represented with solid lines in FIGS. 2, 3, and 7 to 9 when the pistons 83 extend; and the inter support arms 80 are located at supporting positions represented with solid lines in FIGS. 5 and 6 when the pistons 83 contract.

Figure 10:
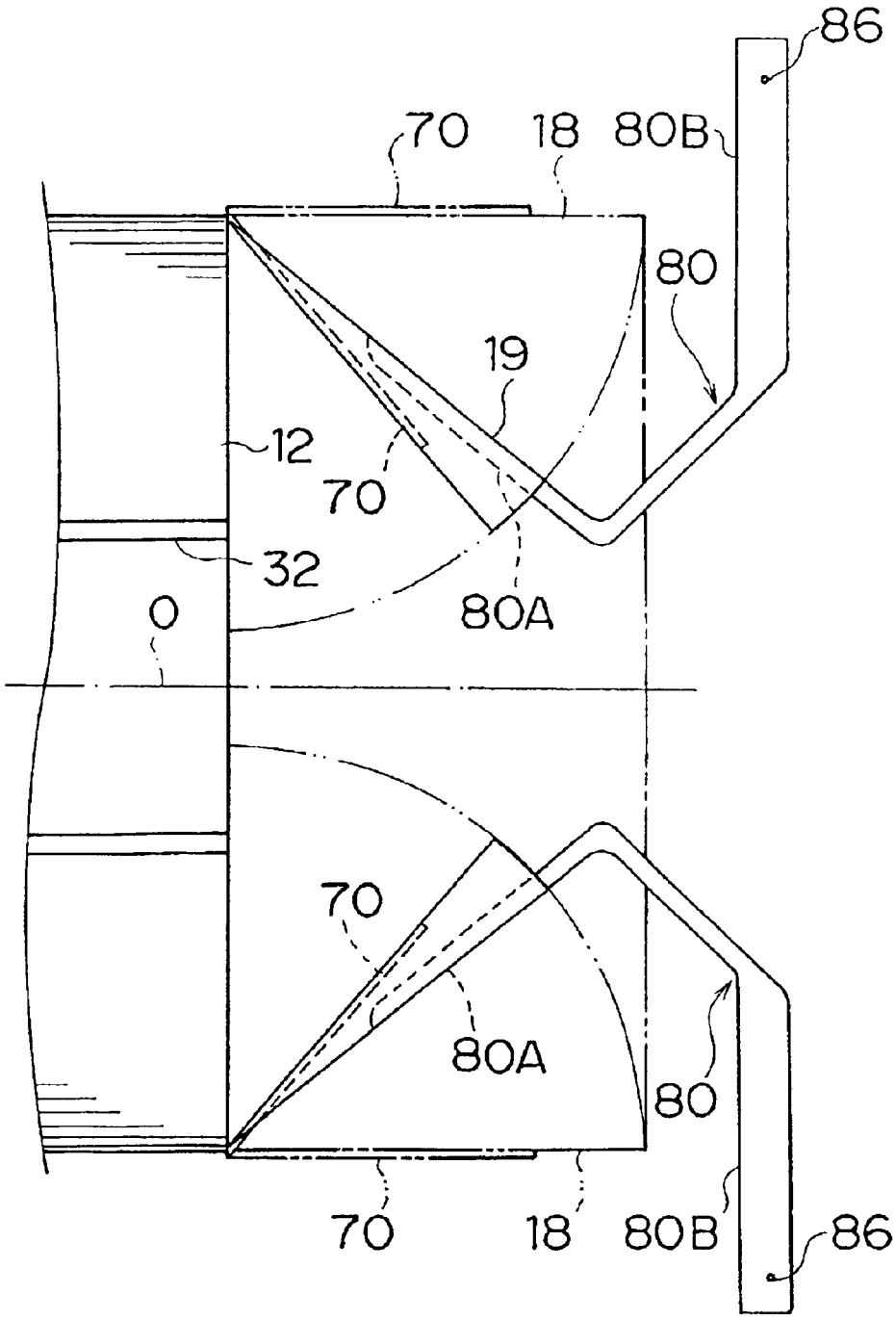
FIG. 10 is an explanatory view showing an operation of the inter support arm.

Each of the inter support arms 80 is formed in an L-character shape, and has, as shown in FIG. 10, a supporting portion 80A, which comes into line-contact with the inner side of the end surface wrapping material 18. In such a manner that the supporting portion 80A can be inserted into and extracted from an opening formed in an oblique direction between the plate-shaped folding members 70 and 70 shown in FIG. 4, that is, in such a manner that the supporting portion 80A can swing in an oblique direction with respect to the roll end surface 13 (see FIG. 2), a proximal end 80B of the inter support arm 80 is swingably supported by the pin 86.

The bushing press-in unit 46 comprises a bushing receiving air cylinder device 90 and a bushing press-in air cylinder device 92. These air cylinder devices 90 and 92 are coaxially coupled such that respective pistons 91 and 93 extend and contract in opposite directions.

Figure 5:
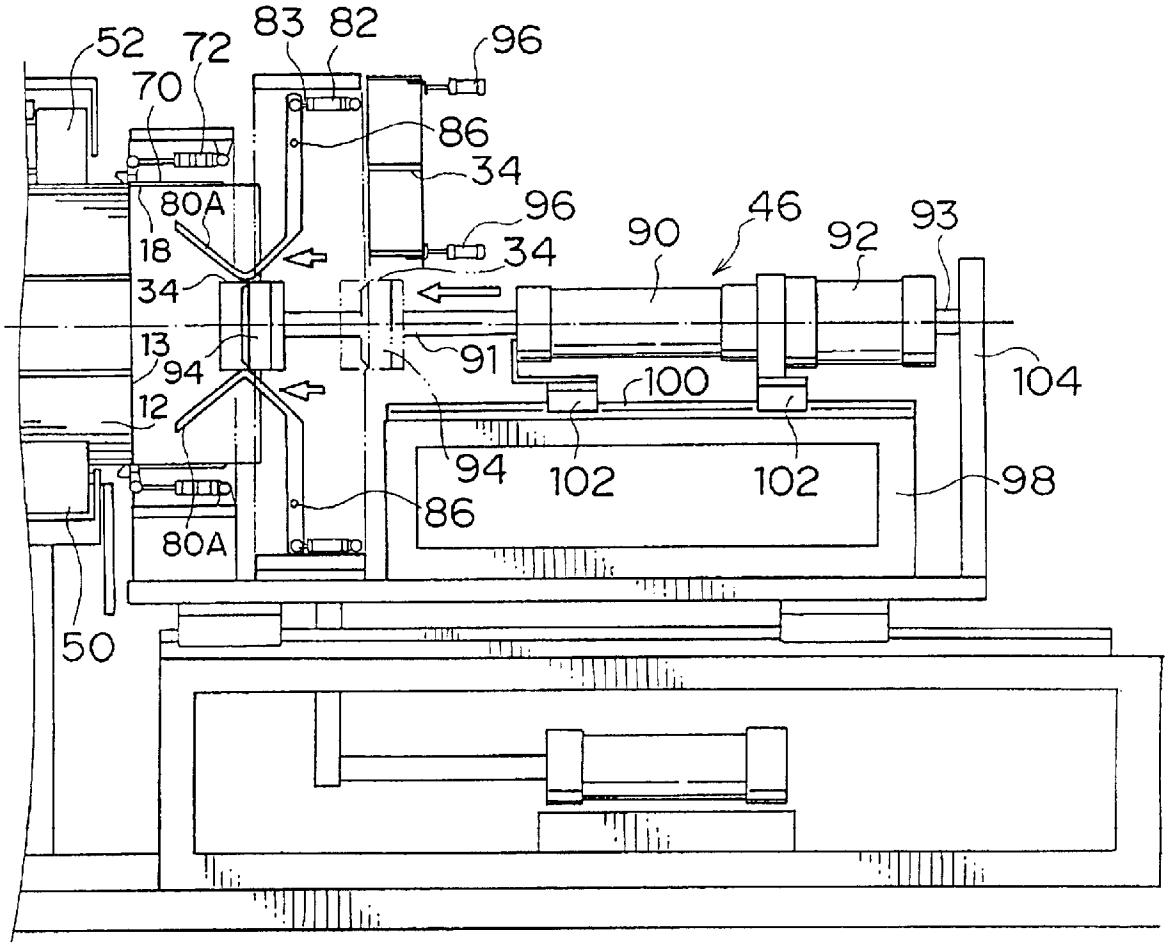
FIG. 5 is an explanatory view when an inter support arm has been positioned at the supporting position.

A bushing drive fitment 94 is mounted on the piston 91 of the air cylinder device 90. The bushing drive fitment 94 is engaged with the bushing 34 set in a press-in standby position when the piston 91 is extended as shown in FIG. 5. In this respect, the bushings 34 are stored in a hopper (not shown) in a vertical direction, and are supplied from the hopper to the press-in standby position one piece at a time by bushing escapers 96, 96.

Figure 11:
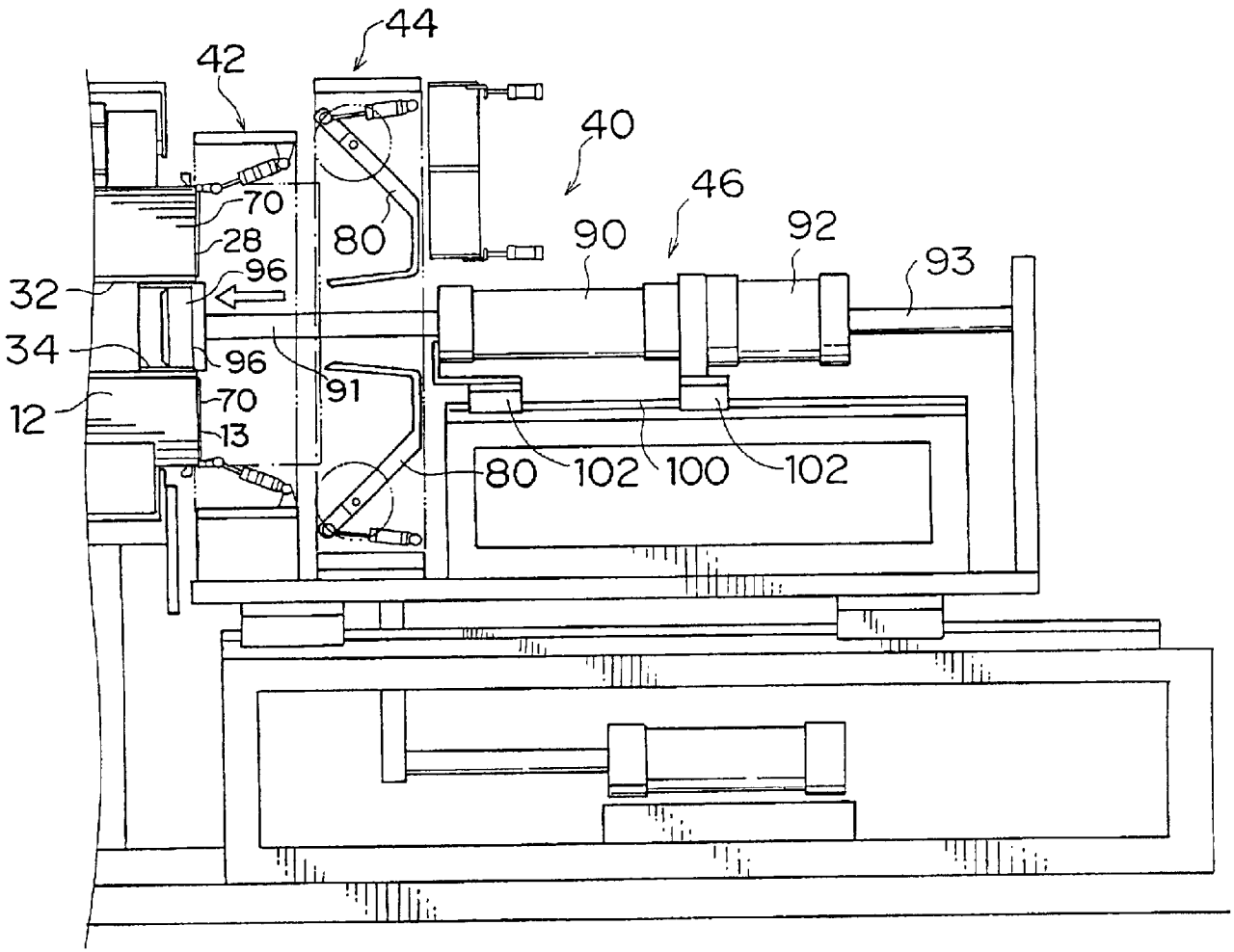
FIG. 11 is an explanatory view when a bushing has been pressed into a core portion.

Further, the air cylinder devices 90 and 92 are movably supported by a guide rail 100 laid on a frame 98 through linear sliders 102, 102. The frame 98 is set up on the table 54, and the guide rail 100 is arranged in a direction orthogonal to the end surface 13 of the roll product 12 set on the gather-folding stage 48. Also, the piston 93 of the air cylinder device 92 is fixed to a plate 104 vertically provided on the table 54. Therefore, by the extension operation of the piston 93, the bushing 34 can be pressed into the core 32 through the bushing drive fitment 94 as shown in FIG. 11.

Next, the description will be made of an operation of the gather-folding apparatus 40 constructed as described above.

First, the fold unit 42, the inter support member 44 and the press-in unit 46 which constitute the gather-folding apparatus 40 as shown in FIG. 2, are caused to retract at a side position of the gather-folding stage 48, and the roll product 12 around which the light-shielding sheet 14 is wound is set onto the receiving rolls 50, 50 of the gather-folding stage 48.

Next, the driving roller 52 is caused to move downward as shown in FIG. 3 to abut on the upper portion of the roll product 12, and the roll product 12 is pinched between the receiving rollers 50, 50 and the driving roller 52. At this time, the roll product 12 is positioned at a position where its central axis O coincides with the central axis P of the gather-folding apparatus 40. Then, in synchronism with the downward movement of the driving roller 52, the gather-folding apparatus 40 is caused to advance and move toward the roll product 12 by the operation of the air cylinder device 64, and the cylindrical end surface wrapping material 18 is relatively inserted into within an opening 71 to be formed by the plate-shaped folding members 70, 70 . . . of the fold unit 42 to cause the plate-shaped folding members 70, 70 . . . to come into plane-contact with the outer peripheral surface of the end surface wrapping material 18.

Subsequently, the inter support arms 80, 80 . . . are caused to rotate as represented with solid lines in FIG. 5 to position at the supporting positions inside the end surface wrapping material 18. In synchronization with this operation, the piston 91 of the air cylinder device 90 is extended, the bushing drive fitment 94 is caused to engage with the bushing 34 set in the press-in standby position, and the bushing 34 is positioned at an opposite position immediately before the core 32.

Figure 6:
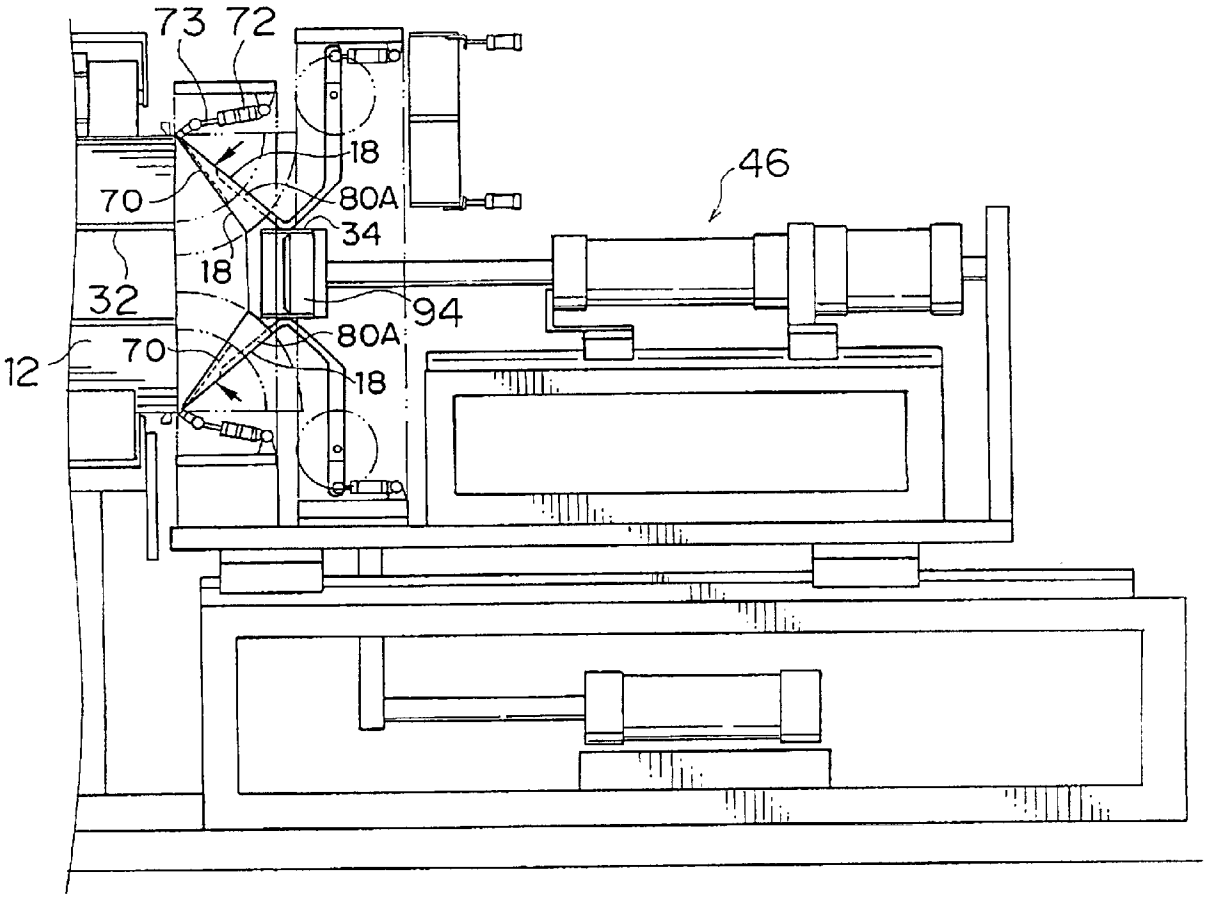
FIG. 6 is an explanatory view when the plate-shaped folding member has been positioned at a pleated portion formation position.
Figure 14:
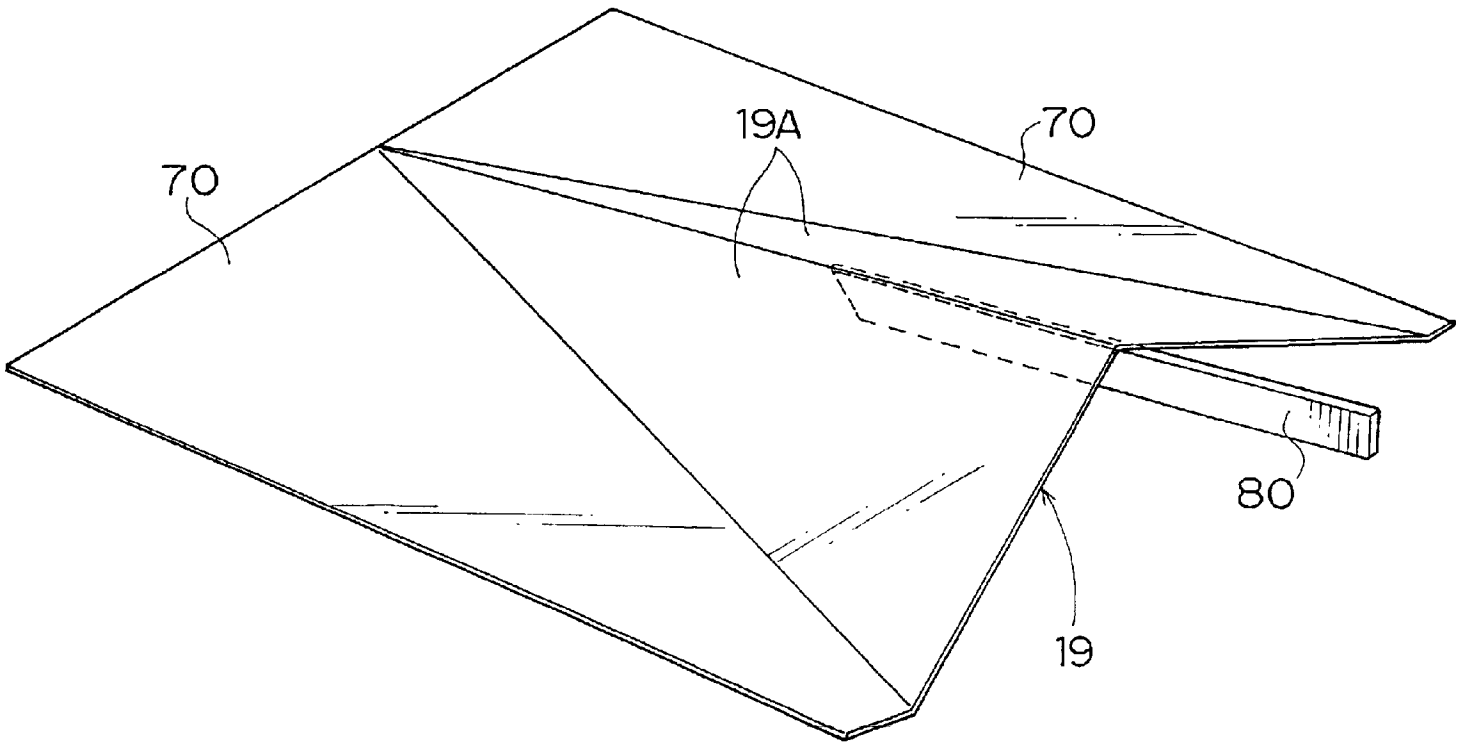
FIG. 14 is an enlarged view showing an angle pleated portion formed by the plate-shaped folding member and the inter support arm.

Next, as shown in FIG. 6, the air cylinder devices 72, 72 . . . are operated (in the first stage operation), and the plate-shaped folding members 70, 70 . . . are positioned at the pleated portion formation positions. Thus, as shown in FIGS. 4 and 10, the end surface wrapping material 18 can be formed with angle pleated portions 19, 19 . . . by means of the plate-shaped folding members 70, 70 . . . , which come into plane-contact with the outer peripheral surface of the end surface wrapping material 18, and the inter support arms 80, 80 . . . , which come into line-contact with the inner peripheral surface of the end surface wrapping material 18. More specifically, according to this gather-folding apparatus 40, when one piece of angle pleated portion 19 is viewed, between two pieces of plane of the plate-shaped folding members 70, 70 and one piece of line of the inter support arm 80, two pieces of fold plane 19A, 19A sandwiching the line concerned are formed as shown in FIG. 14. In this case, since these two fold planes 19A, 19A can be formed with uniform tension, the angle pleated portion 19 comprising these two fold planes 19A, 19A can be formed with stability.

Figure 7:
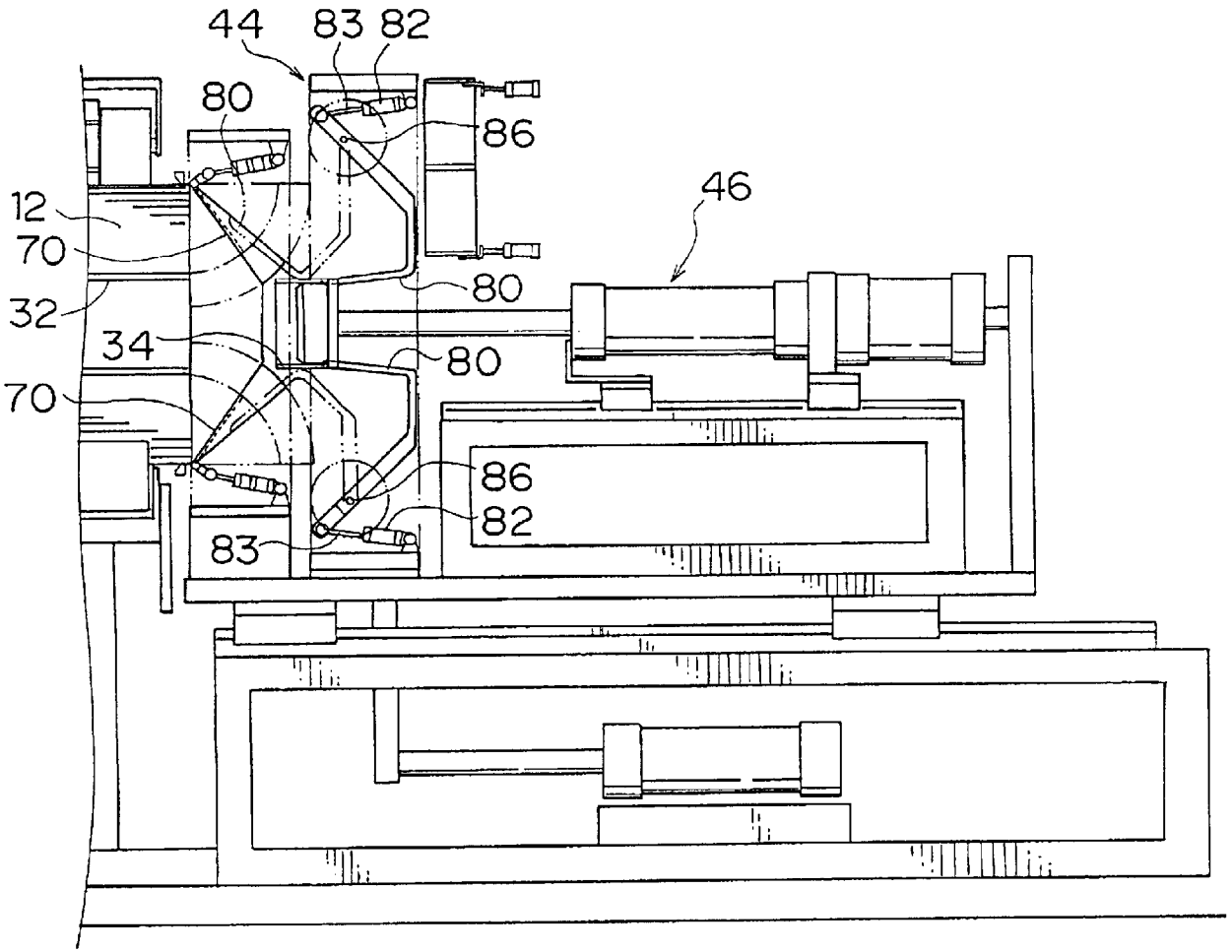
FIG. 7 is an explanatory view when the inter support arm has been returned to a retracted position.
Figure 8:
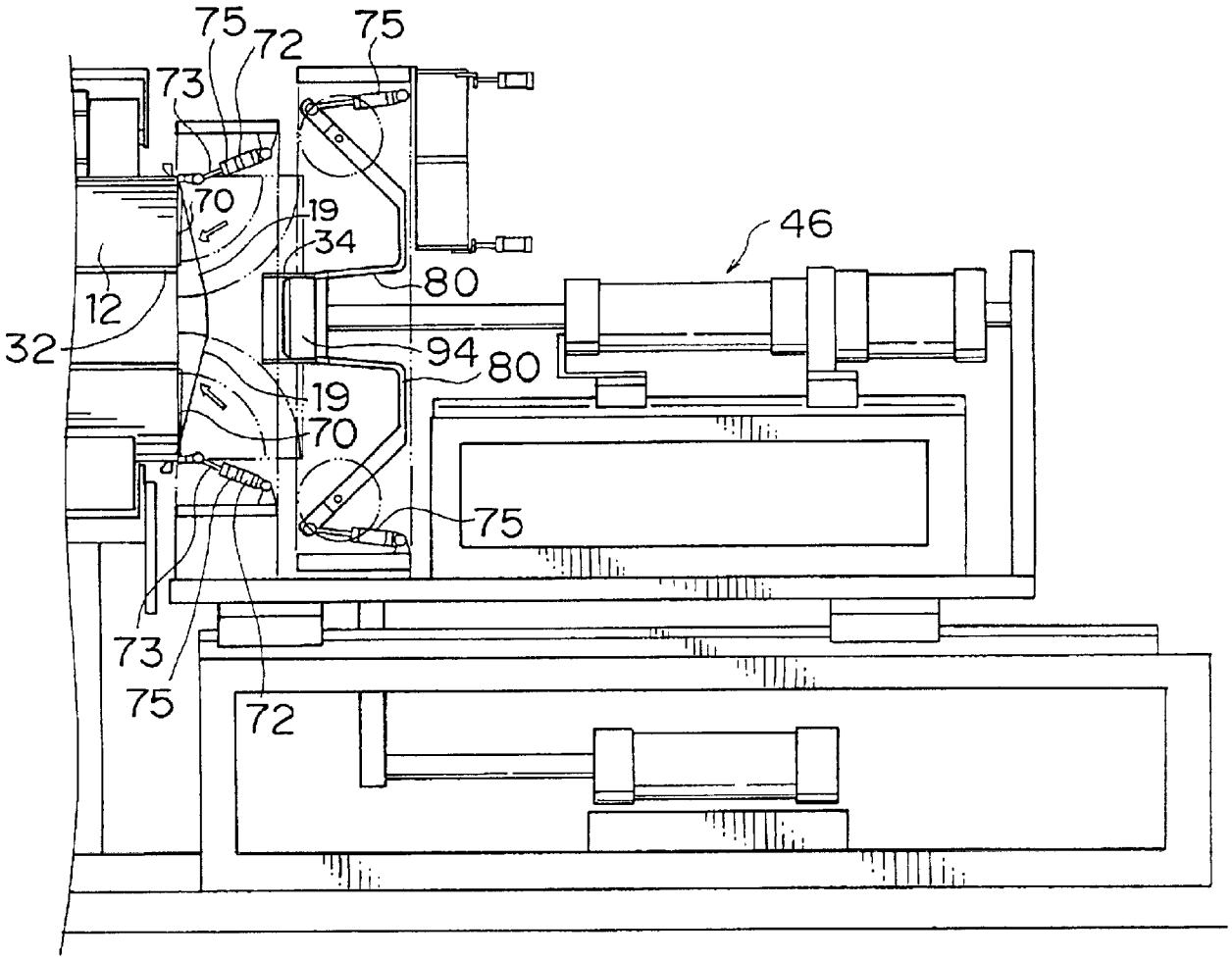
FIG. 8 is an explanatory view when the plate-shaped folding member has been positioned at a gather-folding formation position.
Figure 9:
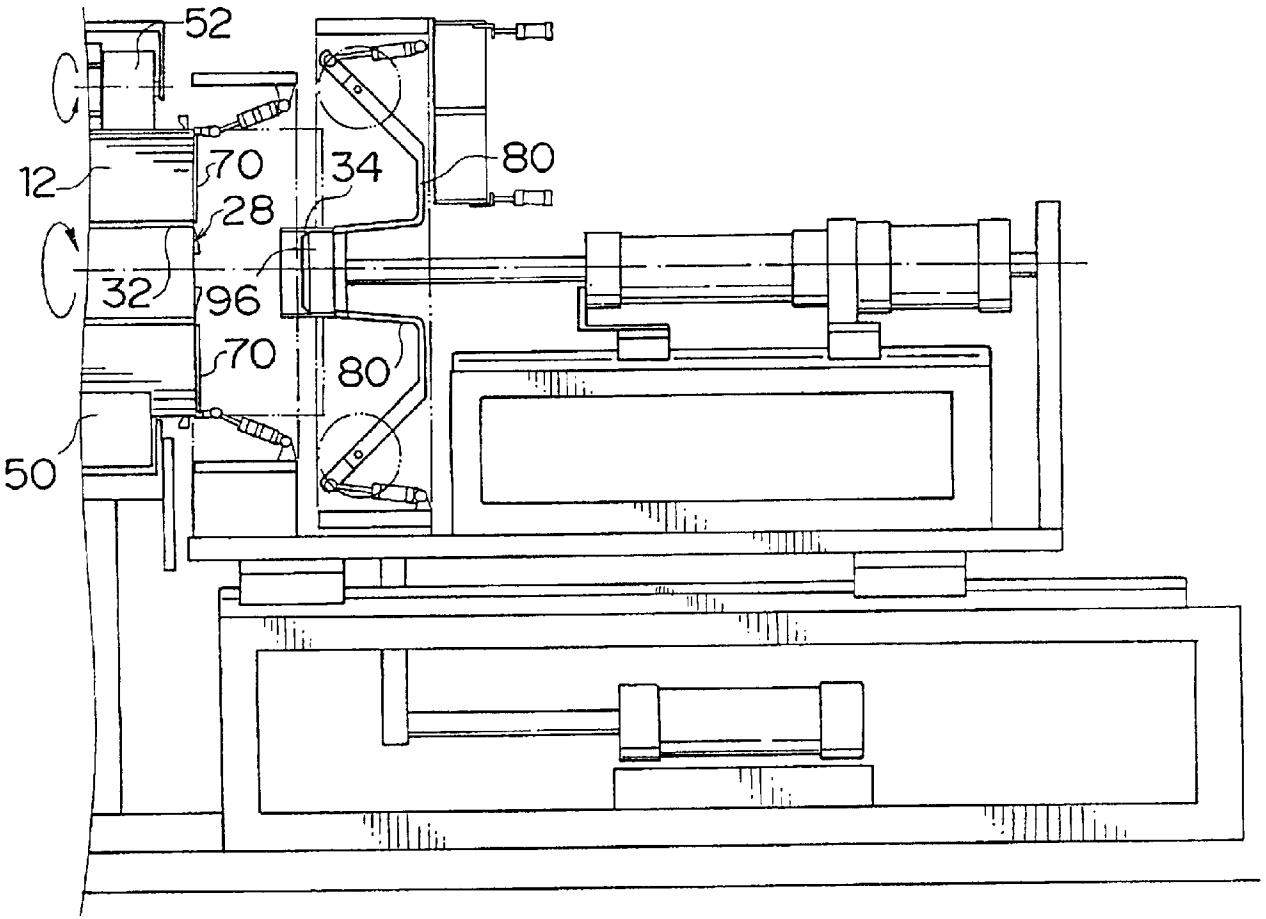
FIG. 9 is an explanatory view when the roll product has been rotated to form the gather-folded portion by the plate-shaped folding member.

Next, the inter support arms 80, 80 are caused to swing in the opposite direction to the previous operation as shown in FIG. 7 to return to the retracted positions represented with solid lines in FIG. 7. Then, the air cylinder devices 75, 75 . . . are operated (in the second stage operation) as shown in FIG. 8 to move the plate-shaped folding members 70, 70 toward the end surface 13 of the roll product 12, and the angle pleated portions 19, 19 . . . are brought near to the end surface 13. Then, the driving roller 52 is caused to rotate in a direction represented with an arrow as shown in FIG. 9 to rotate the roll product 12 in the direction represented with an arrow. The angle of rotation of the roll product 12 has been set to an angle of one or more pitches of the angle pleated portions 19. Thus, the angle pleated portions 19, 19 . . . are folded on the end surface 13 by the plate-shaped folding members 70, 70 . . . so that the gather-folded portion 28 (see FIG. 1) is formed on the end surface 13.

Figure 13:
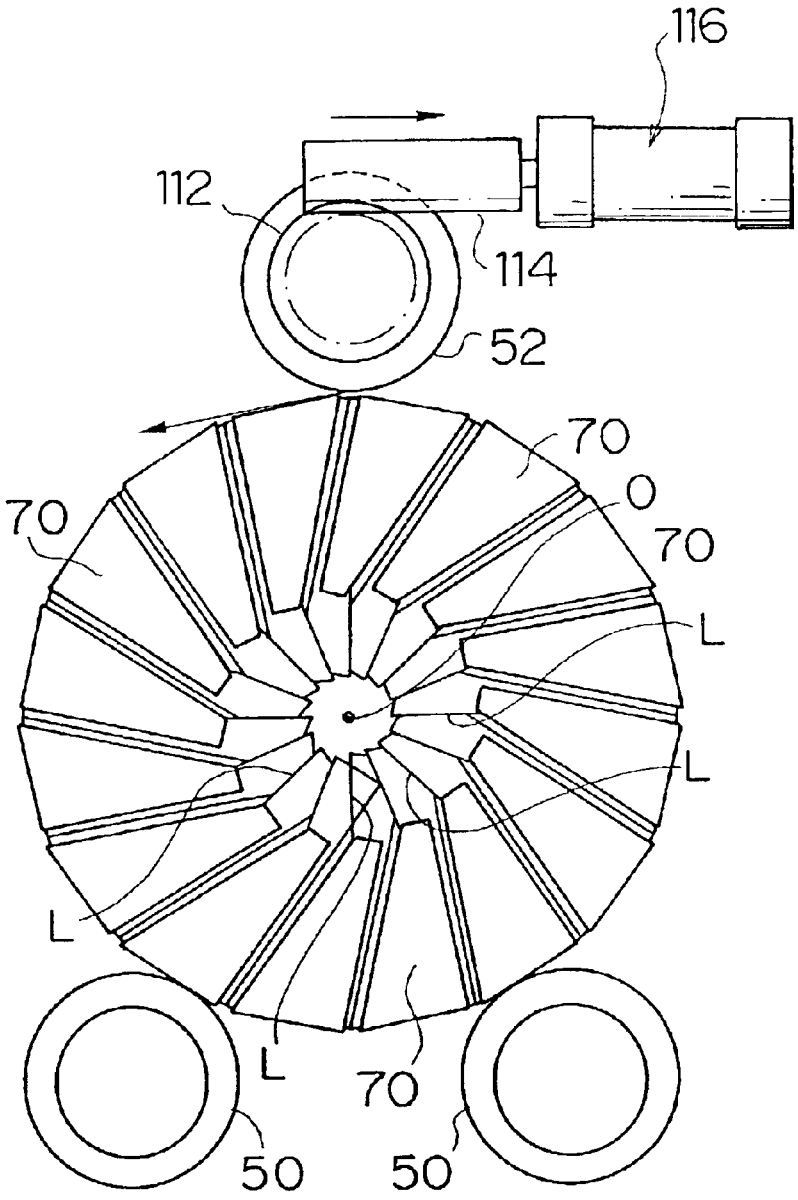
FIG. 13 is a front view when the roll product has been rotated to form the gather-folded portion by the plate-shaped folding member.

FIGS. 12 and 13 show an example of a driving unit 110 of a driving roller 52. This driving unit 110 is composed of a pinion 112, a rack 114 and an air cylinder device 116. The pinion 112 is provided coaxially with the driving roller 52, and is engaged with the rack 114. The rack 114 is coupled to the piston 117 of the air cylinder device 116. Therefore, when the piston 117 is caused to contract from the piston extended state of FIG. 12, the rack 114 moves in the right-hand direction in FIG. 12, and therefore, the driving roller 52 rotates in the clockwise direction in FIG. 12 through the pinion 112. Thus, the roll product 12 rotates in the counter-clockwise direction in FIG. 12, and rotates over the angle of one or more pitches of the angle pleated portions 19 to stop at the position shown in FIG. 13.

Figure 15:
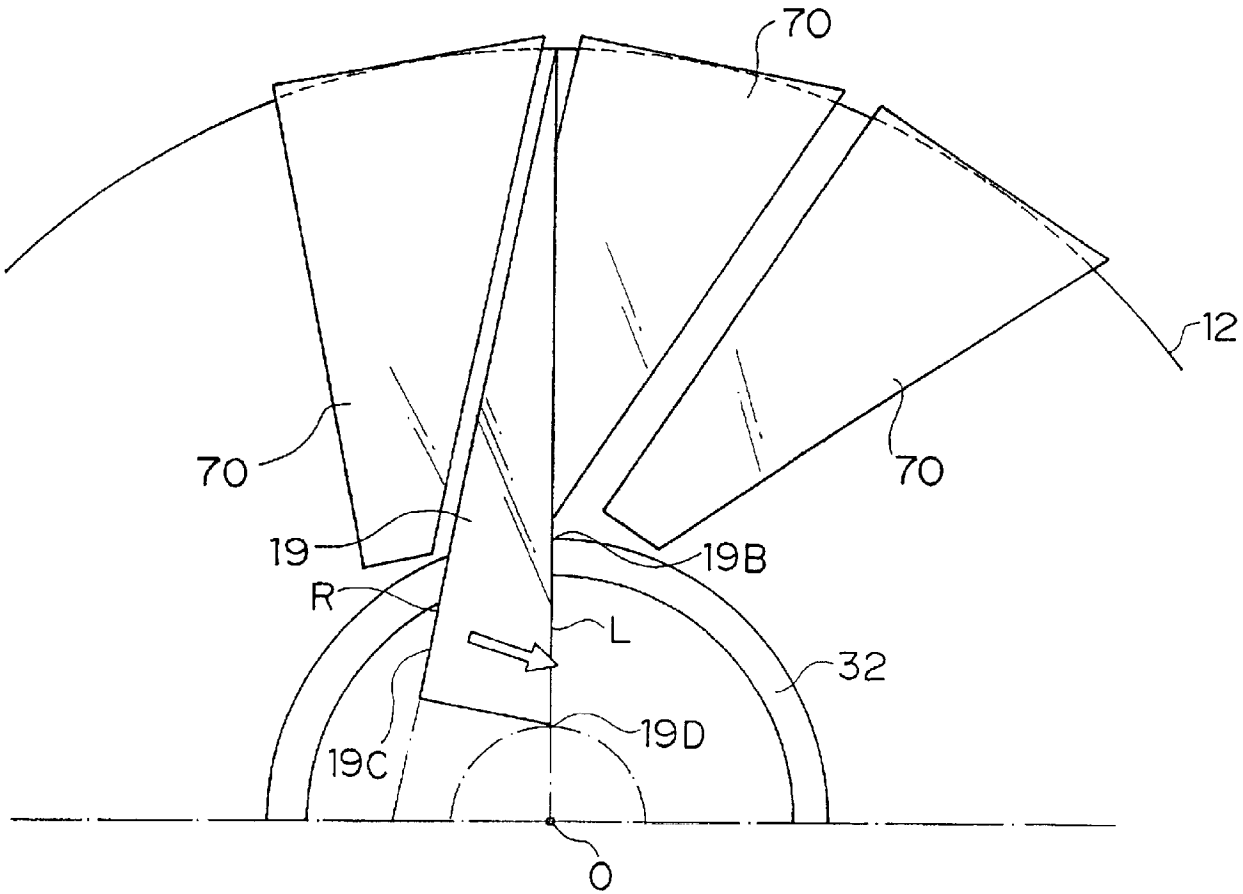
FIG. 15 is an explanatory view showing an angle of fold of the angle pleated portion when a rectangular triangle plate-shaped folding member has been used.

Since the plate-shaped folding members 70 are formed in a rectangular triangle shape, when the angle pleated portions 19 formed by the plate-shaped folding members 70 are folded out, ridges L, L . . . of crest folded portions of all the angle pleated portions 19, 19 . . . are directed toward the central axis O of the roll product 12 as shown in FIGS. 13 and 15. Also, each of the angle pleated portions 19 lies on the angle pleated portion 19 adjacent thereto, and further, the ridge L of the crest folded portion 19B is longer than the ridge R of the trough folded portion 19C as shown in FIG. 15, and an apex 19D of the crest folded portion 19B approaches the central axis O of the roll product 12. In other words, the plate-shaped folding member 70 is formed in the rectangular triangle shape, whereby the area of the light-shielding sheet 14 can be made as small as possible to provide the light shielding property and the moisture resistance.

Figure 16:
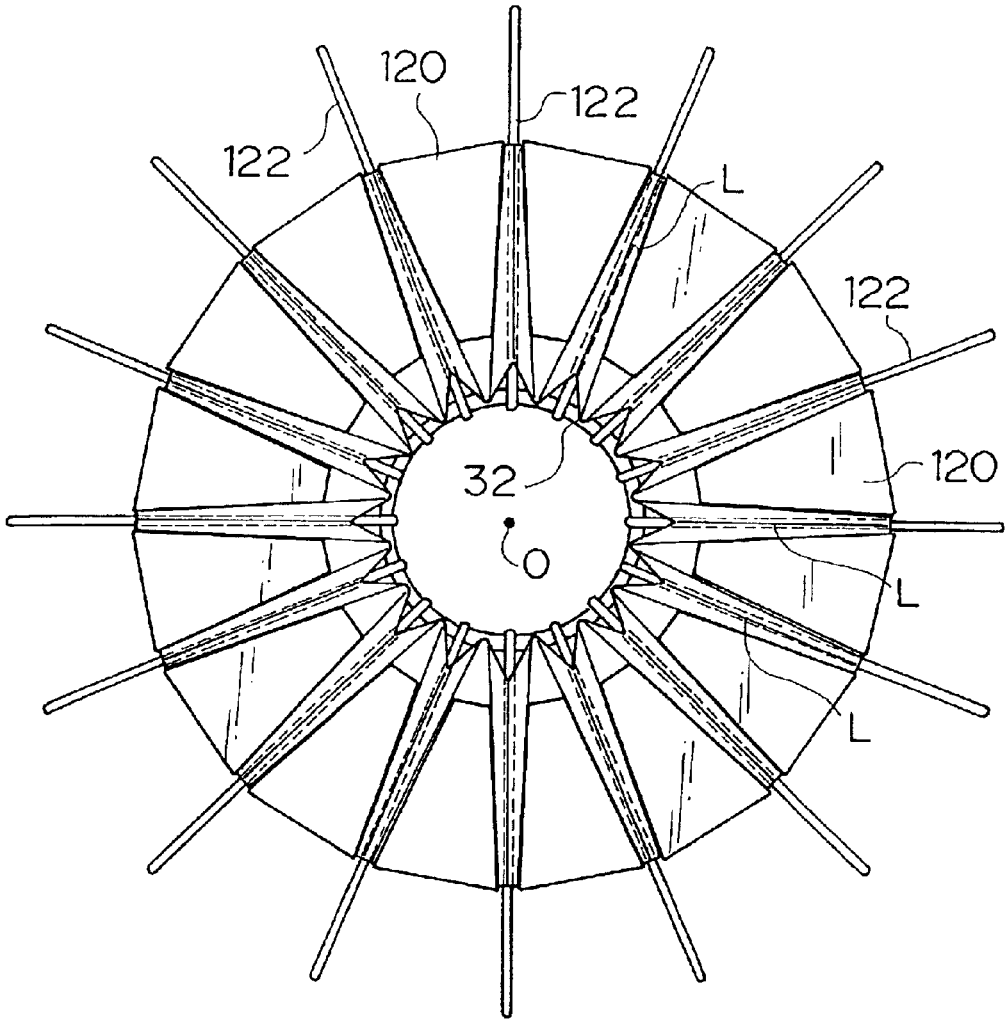
FIG. 16 is a front view showing the plate-shaped folding member when an isosceles triangle plate-shaped folding member has been used.
Figure 17:
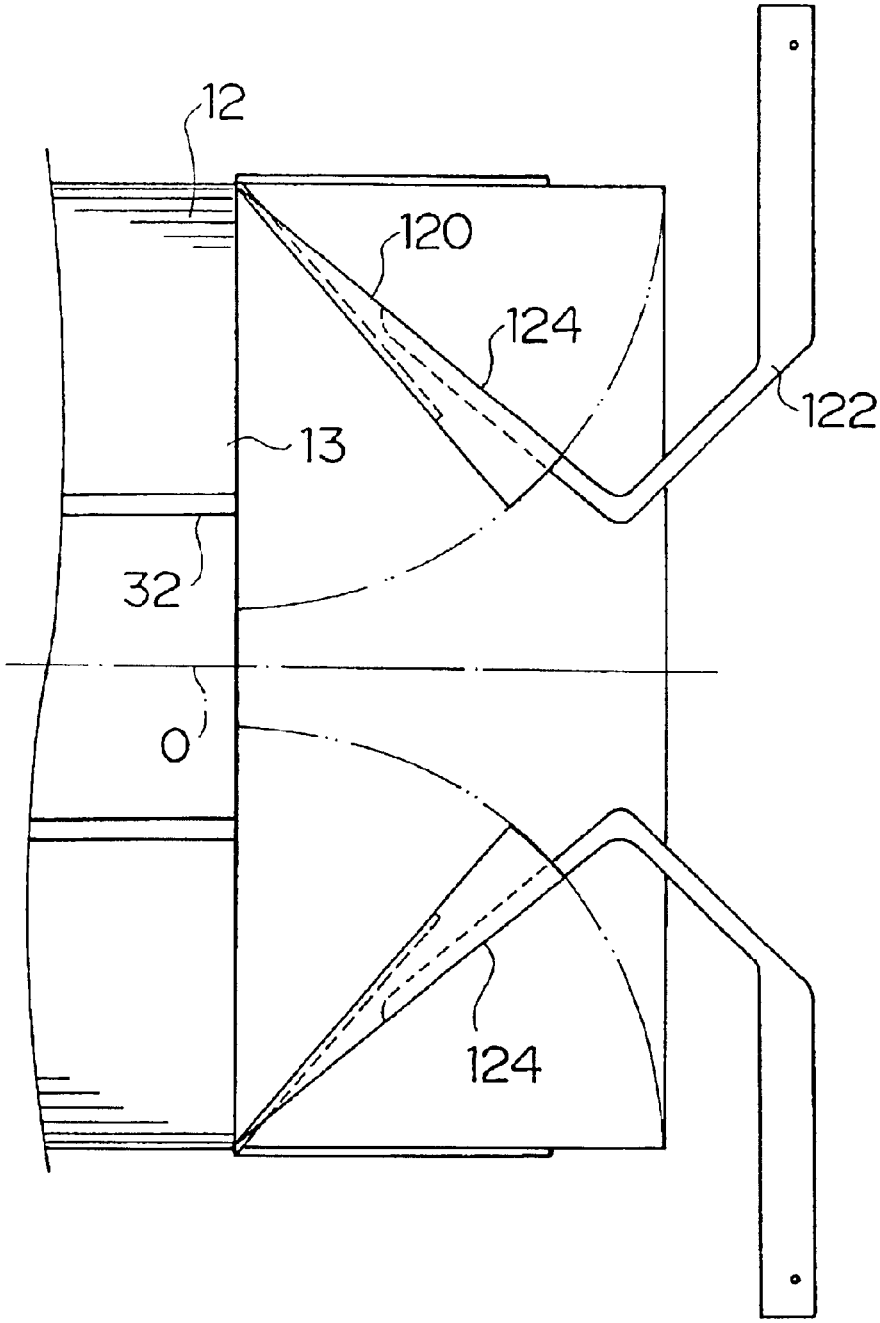
FIG. 17 is an explanatory view showing an operation of the inter support arm shown in FIG. 16.
Figure 18:
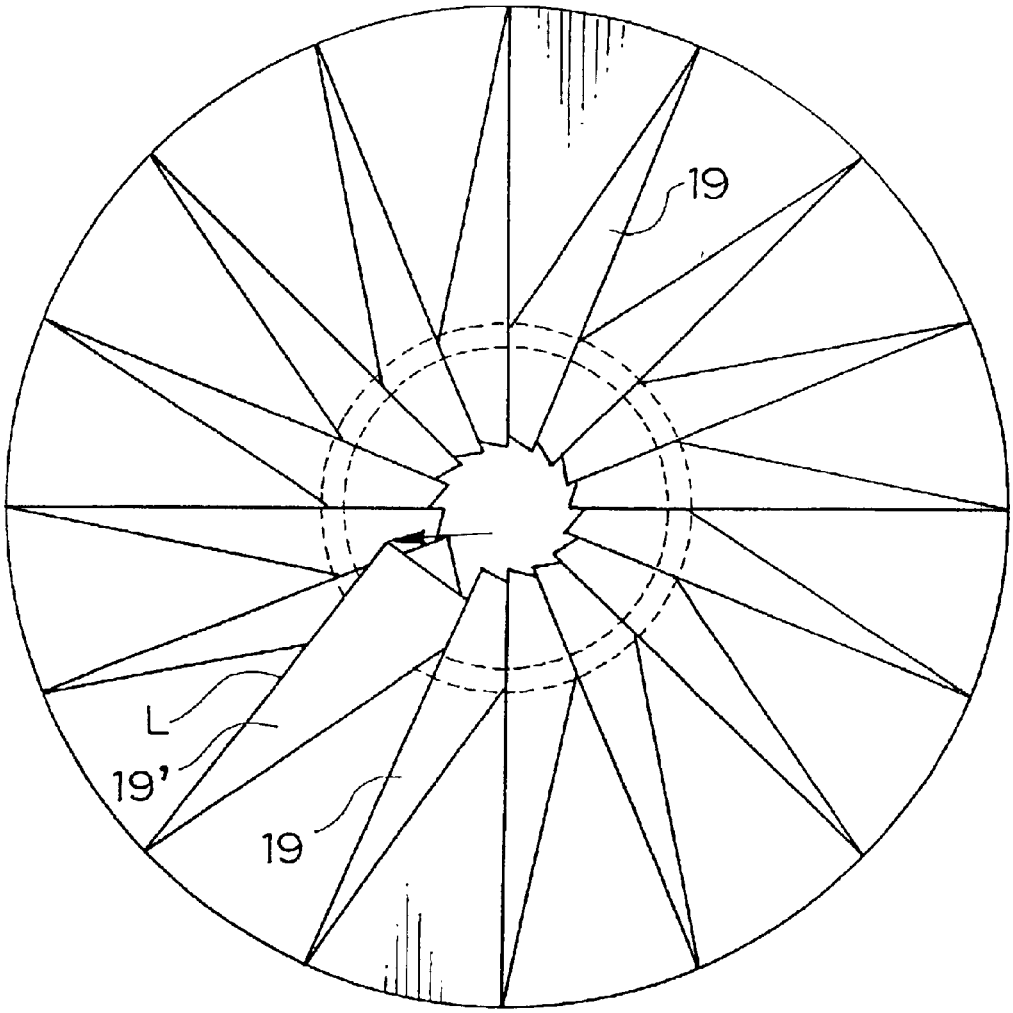
FIG. 18 is a view for explaining unevenness in an angle of fold of the angle pleated portion.
Figure 19:
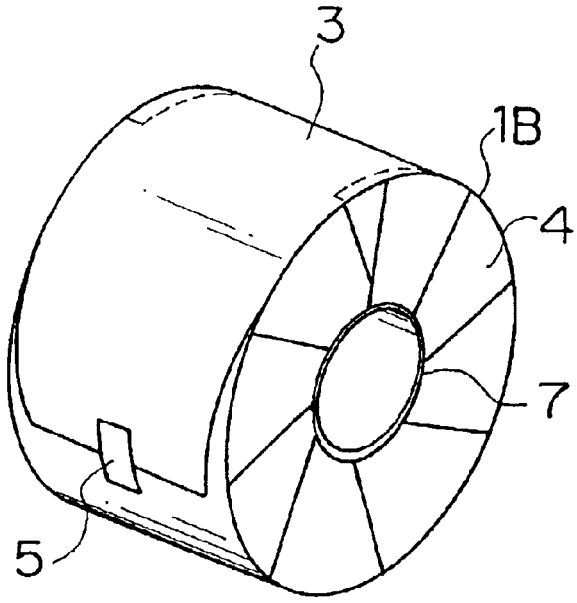
FIG. 19 is a perspective view showing a roll product wrapped with light shielding sheet.
Figure 20:
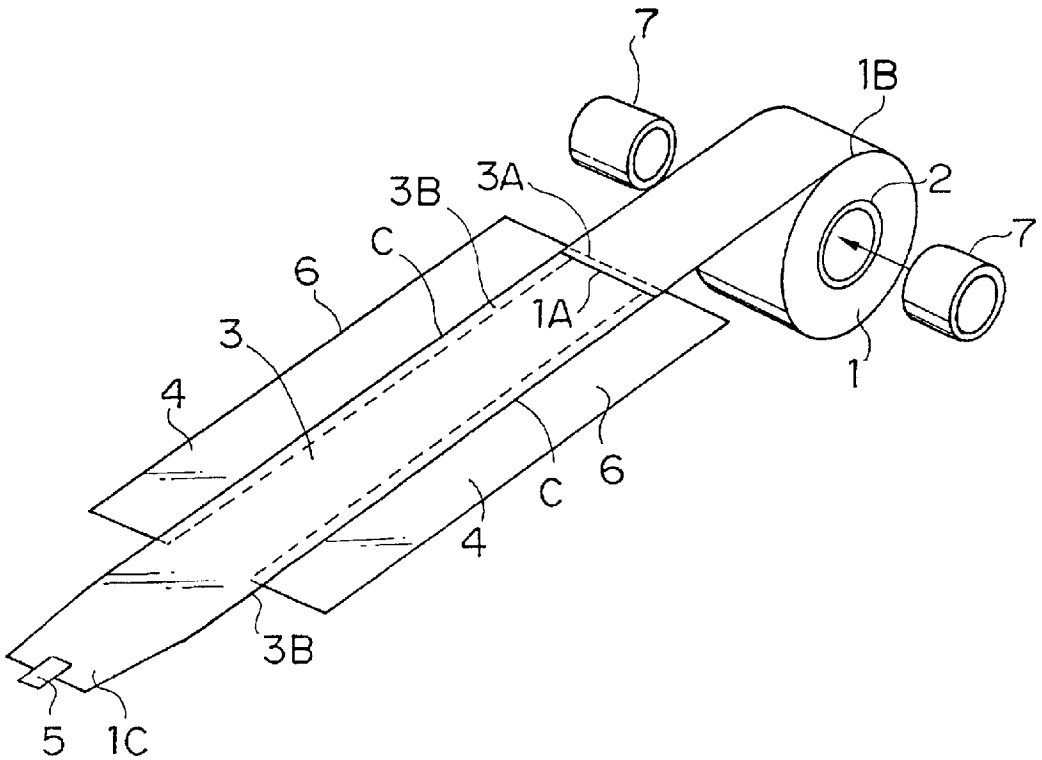
FIG. 20 is a perspective view showing a state before the light shielding sheet is wound around the roll product.

In contrast to this, as shown in FIG. 16, if plate-shaped folding members 120 are formed in a substantially isosceles triangle shape, and by means of these plate-shaped folding members 120 and inter support arms 122, angle pleated portions 124 shown in FIG. 17 are formed. In this case, ridges L of the angle pleated portions 124 are directed to the central axis O of the roll product 12 as shown in FIG. 16, but when these angle pleated portions 124 are folded out by the plate-shaped folding members 122, there exist pleated portions 19' having such short ridges L as shown in FIG. 18 and the apexes of the crest folded portions of which are directed outward. Thus, if the isosceles triangle shaped plate-shaped folding members 120 are used, an excess area sufficient to fit the pleated portions 19' in the light shielding sheet is required, and therefore, the light shielding sheet cannot be made as small as possible.

After the gather-folded portion 28 is formed as described above, the piston 93 of the air cylinder device 92 is extended in a state in which the gather-folded portion 28 has been pressed against the end surface 13 by the plate-shaped folding member 70 as shown in FIG. 11. This operation can press the bushing 34 into the core 32. When the press-in of the bushing 34 is completed, each unit 42, 44, 46 constituting the gather-folding apparatus 40 is returned to the original position shown in FIG. 2. Thereafter, the roll product 12, packaging of which has been completed is taken out of the gather-folding stage 48, and the next roll product 12 before the gather-folding is set on the gather-folding stage 48. In the foregoing, the gather-folding operation by the gather-folding apparatus 40 is completed.

As described above, according to the gather-folding apparatus 40 of the embodiment, since by means of the plate-shaped folding members 70, which come into plane-contact from the outside of the end surface wrapping material 18 and the inter support arms 80, which come into line-contact with the inner peripheral surface of the end surface wrapping material 18, the angle pleated portions 19 are formed, the angle pleated portions 19 can be formed with stability as compared with the conventional gather-folding apparatus.

Also, according to the gather-folding apparatus 40, since by means of both the operation for positioning the inter support arms 80 at the supporting positions shown in FIG. 5, and the operation for positioning the plate-shaped folding members 70 at the pleated portion formation positions shown in FIG. 6, the angle pleated portions 19 can be formed, the packaging tact is improved.

Further, according to the gather-folding apparatus 40, in such a manner that the inter support arms 80 are formed in an L-character shape and that the supporting unit bodies 80A of the inter support arms 80 can move in an oblique direction with respect to the roll end surface 13, the proximal ends 80B of the inter support arms 80 are pivotally supported.

Thus, only by causing the inter support arms 80 to swing between the supporting positions shown in FIG. 5 and the retracted positions shown in FIG. 3, it is possible to retract the inter support arms 80 from an insertion area of the bushing 34 into the core 32. Accordingly, the insertion tact of the bushing 34 is improved.

As described above, according to the gather-folding apparatus of the packaging apparatus for roll products of the present invention, since by means of both the plate-shaped folding members, which come into plane-contact with the cylindrical portion of the sheet from the outside and the bar-shaped inter support members, which come into line-contact with the inner peripheral surface of the cylindrical portion, the angle pleated portions are formed, the angle pleated portions can be formed with stability.

Also, according to the gather-folding apparatus of the present invention, since the folding members are formed in the rectangular triangle shape, the light shielding property and the moisture resistance of the gather-folded portion can be improved with a minimum area of wrapping material.

Further, according to the gather-folding apparatus of the present invention, since in such a manner that the inter support members are formed in the L-character shape and that the supporting unit bodies of the inter support members can move in an oblique direction with respect to the roll end surface, the proximal ends of the inter support members are pivotally supported. Therefore, the insertion tact of the bushing member is improved.

Also, according to the package of the roll product of the present invention, since the crest folded portions of the plurality of angle pleated portions for forming the gather-folded portion are formed such that their ridges are longer than the ridges of the trough folded portions, that the gather-folding has been performed such that each of the angle pleated portions lies on the angle pleated portion adjacent thereto, and that the ridge portions of the crest folded portions are directed toward the roll central axis product, the area of the sheet can be made as small as possible to provide the light shielding property and the moisture resistance.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A package of a role product, which covers an outer peripheral surface of a roll made of a belt-shaped photosensitive film material wound around a cylindrical core in a roll shape with a sheet having larger width than the width of the roll to gather-fold a cylindrical portion of the sheet protruding outwardly from an end surface of the roll by a gather-folding apparatus along the roll end surface, and which a bushing member is pressed into the core to thereby fit an inner peripheral edge of a gather-folded portion by the core and the bushing member, wherein ridges of crest folded portions of a plurality of angle pleated portions which form the gather-folded portion are formed to be longer than ridges of trough folded portions; when gather-folding is performed, each of the angle pleated portions lies on top of the angle pleated portion adjacent thereto; and the ridges of the crest folded portions face a center of the roll product.

* * * * *